US010276111B2

(12) United States Patent
Zhang

(10) Patent No.: US 10,276,111 B2
(45) Date of Patent: Apr. 30, 2019

(54) MURA COMPENSATION METHOD FOR DISPLAY PANEL AND DISPLAY PANEL

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days.

(21) Appl. No.: 15/552,289

(22) PCT Filed: May 24, 2017

(86) PCT No.: PCT/CN2017/085758
§ 371 (c)(1),
(2) Date: Aug. 20, 2017

(87) PCT Pub. No.: WO2018/201534
PCT Pub. Date: Nov. 8, 2018

(65) Prior Publication Data

US 2018/0322833 A1 Nov. 8, 2018

(30) Foreign Application Priority Data

May 3, 2017 (CN) ..... 2017 1 0305909

(51) Int. Cl.
*G09G 5/10* (2006.01)
*G09G 3/36* (2006.01)
*G09G 3/20* (2006.01)

(52) U.S. Cl.
CPC ..... *G09G 3/3607* (2013.01); *G09G 3/2007* (2013.01); *G09G 3/3611* (2013.01);
(Continued)

(58) Field of Classification Search
USPC ..... 345/89, 690, 586, 189, 694
See application file for complete search history.

(56) References Cited

U.S. PATENT DOCUMENTS 9,464,962 B2 * 10/2016 Kim ..... G01M 11/064 345/89
2010/0141559 A1 * 6/2010 Hwang ..... G09G 5/003 345/58

(Continued)

*Primary Examiner* — Thuy N Pardo
(74) *Attorney, Agent, or Firm* — Andrew C. Cheng

(57) ABSTRACT

A mura compensation method for display panel is disclosed, including: storing a plurality of compensation values of the display panel performing mura grayscale compensation, the plurality of compensation values corresponding to compensation by the display panel for different grayscales, the compensation value corresponding to a lowest grayscale $g_{min}$ among different grayscales being a first compensation value a; obtaining a head compensation value m corresponding to grayscale 0, m being not 0; obtaining a current grayscale of the display panel; if the current grayscale of the display panel being between grayscale 0 and the lowest grayscale $g_{min}$, performing linear interpolation based on the first compensation value a and the head compensation value m to obtain a first target compensation value corresponding to the current grayscale; based on the first target compensation value, performing compensation to the current grayscale of the display panel. A display panel is also disclosed.

8 Claims, 4 Drawing Sheets

(52) U.S. Cl.
CPC ..... *G09G 2320/0233* (2013.01); *G09G 2320/0285* (2013.01)

(56) References Cited

U.S. PATENT DOCUMENTS

2013/0083087 A1* 4/2013 Byun ..... G09G 3/3233 345/690
2014/0168451 A1* 6/2014 Lee ..... G09G 3/006 348/189
2015/0187289 A1* 7/2015 Kim ..... G01M 11/064 345/89
2015/0235616 A1* 8/2015 Wu ..... G09G 5/04 345/694
2016/0148582 A1* 5/2016 Chung ..... G09G 3/3611 345/89
2016/0171939 A1* 6/2016 Na ..... G09G 3/20 345/690
2018/0047368 A1* 2/2018 Luo ..... G09G 3/20 345/690
2018/0102099 A1* 4/2018 Na ..... G09G 3/20 345/690
2018/0108288 A1* 4/2018 Kuang ..... G09G 3/2092 345/690

* cited by examiner

MURA COMPENSATION METHOD FOR DISPLAY PANEL AND DISPLAY PANEL

CROSS REFERENCE TO RELATED APPLICATIONS

This application claims the priority of Chinese Patent Application No. CN201710305909.1, entitled "Mura Compensation Method for Display Panel and Display Panel", filed on May 3, 2017, the disclosure of which is incorporated herein by reference in its entirety.

BACKGROUND OF THE INVENTION

1. Field of the Invention

The present invention relates to the field of display, and in particular to the field of mura phenomenon compensation method for display panel and display panel.

2. The Related Arts

Because of various defects in the manufacturing process of liquid crystal display (LCD), the manufactured LCD panel may have non-uniform luminance and display various mura phenomena (the mura phenomenon refers to the marks caused by non-uniform luminance of the display panel.)

To improve the luminance uniformity of the display panel, some mura compensation methods are developed. For example, high-resolution camera is used to take a few grayscale mura forms in the 0-255 grayscales, and in general, a grayscale mura form is selected from the low grayscale region, in the grayscale region, high grayscale region to for photography. By comparing the brightness of the center position of the display panel, the brightness difference between the surrounding area and the center position is computed, and then compensates the grayscale value of the mura location (by reducing the grayscale value for area brighter than the center position to reduce brightness, and increasing the grayscale value for area darker than the center to increase brightness). The rest of the grayscale compensation value is computed by linear interpolation to make the display panel as a whole to achieve a more consistent brightness.

The known linear interpolation method considers the low-medium and medium-high grayscale compensation value is more accurate. The compensation for grayscale between 0 to measure low grayscale is: the default compensation value for grayscale 0 (darkest) is 0, and then the compensation values of other low grayscales are calculated by linear interpolation of the compensation value of grayscale 0 and measured low grayscale. However, refer to FIG. 1. In this figure, a, b, c represent the compensation value for the lowest grayscale $g_{min}$, the middle grayscale $g_{mid}$, and the highest grayscale $g_{max}$. For the each stage between the 0 and the measured lowest grayscale $g_{min}$ (the lowest grayscale $g_{min}$ is relative to the middle grayscale $g_{mid}$ and the highest grayscale $g_{max}$), the mura of each grayscale is more serious; but because the compensation value for 0 is set to 0 (default, not accurate value), the calculation after linear interpolation between compensation data a and 0 has a smaller compensation value for the grayscales between 0 and the measured lowest grayscale $g_{min}$, while the actual grayscale compensation value should be larger (refer to FIG. 1). Therefore the mura compensation result for the grayscales between 0 and the measured lowest grayscale $g_{min}$ is poor.

SUMMARY OF THE INVENTION

The primary object of the present invention is to provide a mura compensation method for display panel and display panel, to alleviate the non-uniform luminance problem of the liquid crystal display (LCD) panel.

To solve the above problem, the present invention provides a mura compensation method for display panel, comprising:

storing a plurality of compensation values of the display panel performing mura grayscale compensation, the plurality of compensation values corresponding to compensation by the display panel for different grayscales, wherein the compensation value corresponding to a lowest grayscale $g_{min}$ among different grayscales being a first compensation value a;

obtaining a head compensation value m corresponding to grayscale 0, wherein m being not 0;

obtaining a current grayscale of the display panel;

if the current grayscale of the display panel being between grayscale 0 and the lowest grayscale $g_{min}$, performing linear interpolation based on the first compensation value a and the head compensation value m to obtain a first target compensation value corresponding to the current grayscale;

based on the first target compensation value, performing compensation to the current grayscale of the display panel.

According to an embodiment of the present invention, wherein m=xa and x is a head compensation coefficient, $0<x<1$.

According to an embodiment of the present invention, wherein a k-th grayscale of the current grayscale located between grayscale 0 and the lowest grayscale $g_{min}$ corresponds to the first target compensation value $y_k$ is computed as:

$$y_k=m+(k-0)*(a-m)/(g_{min}-0).$$

According to an embodiment of the present invention, wherein the head compensation coefficient x is stored in a timing controller or in a data memory.

According to an embodiment of the present invention, wherein the compensation value corresponding to a highest grayscale $g_{max}$ among different grayscales is a third compensation value c, and the method further comprises:

obtaining a tail compensation value n corresponding to grayscale 255, n is not 0;

if the current grayscale of the display panel being between the highest grayscale $g_{max}$ and grayscale 255, performing linear interpolation based on the tail compensation value n and the third compensation value c to obtain a second target compensation value corresponding to the current grayscale;

based on the second target compensation value, performing compensation to the current grayscale of the display panel.

According to an embodiment of the present invention, wherein n=yc, and y is a tail compensation coefficient, $0<y<1$.

According to an embodiment of the present invention, wherein the different grayscales further comprises a middle grayscale $g_{mid}$ and a highest grayscale $g_{max}$; the middle grayscale $g_{mid}$ is between the lowest grayscale $g_{min}$ and the highest grayscale $g_{max}$; the middle grayscale $g_{mid}$ corresponds to a second compensation value b, and the highest grayscale $g_{max}$ corresponds to a third compensation value c; the method further comprises:

if the current grayscale of the display panel being between the lowest grayscale $g_{min}$ and the middle grayscale $g_{mid}$, performing linear interpolation based on the first compensation value a and the second compensation value b to obtain a third target compensation value corresponding to the current grayscale; based on the third target compensation value, performing compensation to the current grayscale of the display panel; or, if the current grayscale of the display panel being between the middle grayscale $g_{mid}$ and the highest grayscale $g_{max}$, performing linear interpolation based on the second compensation value b and the third compensation value c to obtain a fourth target compensation value corresponding to the current grayscale; based on the fourth target compensation value, performing compensation to the current grayscale of the display panel.

The present invention also provides a display panel, comprising: a first storage unit, for storing a plurality of compensation values of the display panel performing mura grayscale compensation, the plurality of compensation values corresponding to compensation by the display panel for different grayscales, wherein the compensation value corresponding to a lowest grayscale $g_{min}$ among different grayscales being a first compensation value a;

a first obtaining unit, for obtaining a head compensation value m corresponding to grayscale 0, wherein m being not 0;

a second obtaining unit, for obtaining a current grayscale of the display panel;

a processing unit, for performing: if the current grayscale of the display panel obtained by the second obtaining unit being between grayscale 0 and the lowest grayscale $g_{min}$, performing linear interpolation based on the first compensation value a and the head compensation value m to obtain a first target compensation value corresponding to the current grayscale; and a compensation unit, for, based on the first target compensation value, performing compensation to the current grayscale of the display panel.

According to an embodiment of the present invention, wherein m=xa and x is a head compensation coefficient, $0<x<1$; the display panel further comprises a second storage unit, for storing the head compensation coefficient x.

According to an embodiment of the present invention, wherein the first storage unit is a data memory, and the second storage unit is a data memory or a timing controller.

The embodiments of the present invention provides the following advantages:

Because the head compensation value corresponding to grayscale 0 is not defaulted to 0, but an actual head compensation value m close to actual value, so that the first target compensation value obtained by linear interpolation for the grayscales between the grayscale 0 and the lowest grayscale $g_{min}$ will be closer to the actual compensation value, resulting in a better mura compensation effect for the grayscales between the grayscale 0 and the lowest grayscale $g_{min}$ and leading to better display effect.

BRIEF DESCRIPTION OF THE DRAWINGS

To make the technical solution of the embodiments according to the present invention, a brief description of the drawings that are necessary for the illustration of the embodiments will be given as follows. Apparently, the drawings described below show only example embodiments of the present invention and for those having ordinary skills in the art, other drawings may be easily obtained from these drawings without paying any creative effort.

DETAILED DESCRIPTION OF THE PREFERRED EMBODIMENTS

To further explain the technical means and effect of the present invention, the following refers to embodiments and drawings for detailed description. Apparently, the described embodiments are merely some embodiments of the present invention, instead of all embodiments. All other embodiments based on embodiments in the present invention and obtained by those skilled in the art without departing from the creative work of the present invention are within the scope of the present invention.

The terms "comprising" and "having" and any variations thereof appearing in the specification, claims, and drawings of the present application are intended to cover non-exclusive inclusion. For example, a process, method, system, product, or device that includes a series of steps or units is not limited to the listed steps or units, but optionally also includes steps or units not listed, or alternatively, other steps or units inherent to these processes, methods, products or equipment. In addition, the terms "first", "second" and "third" are used to distinguish different objects, and are not intended to describe a particular order.

The First Embodiment

Figure 1:
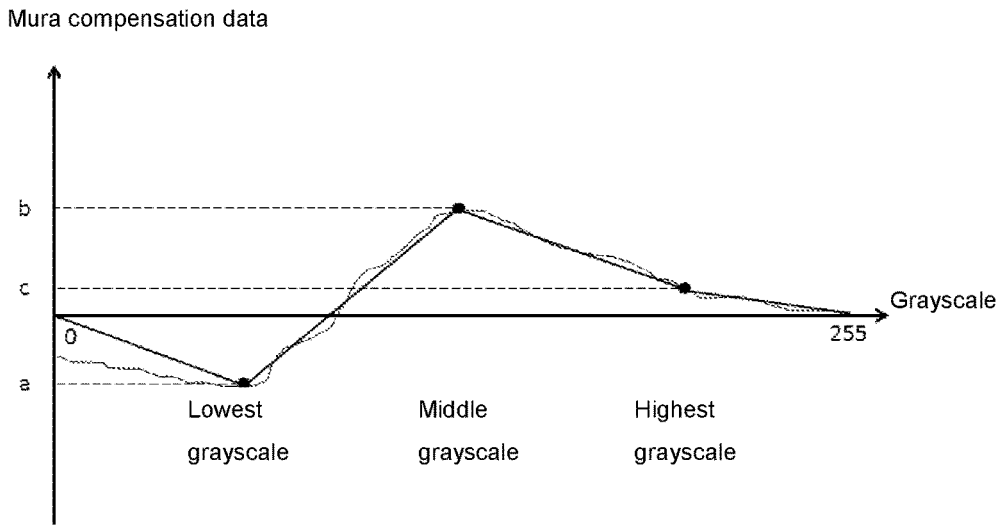
FIG. 1 is a schematic view showing the comparison between the actual needed mura compensation (solid curve) and the actual mura compensation (solid line) obtained by linear interpolation in the know technology.
Figure 2:
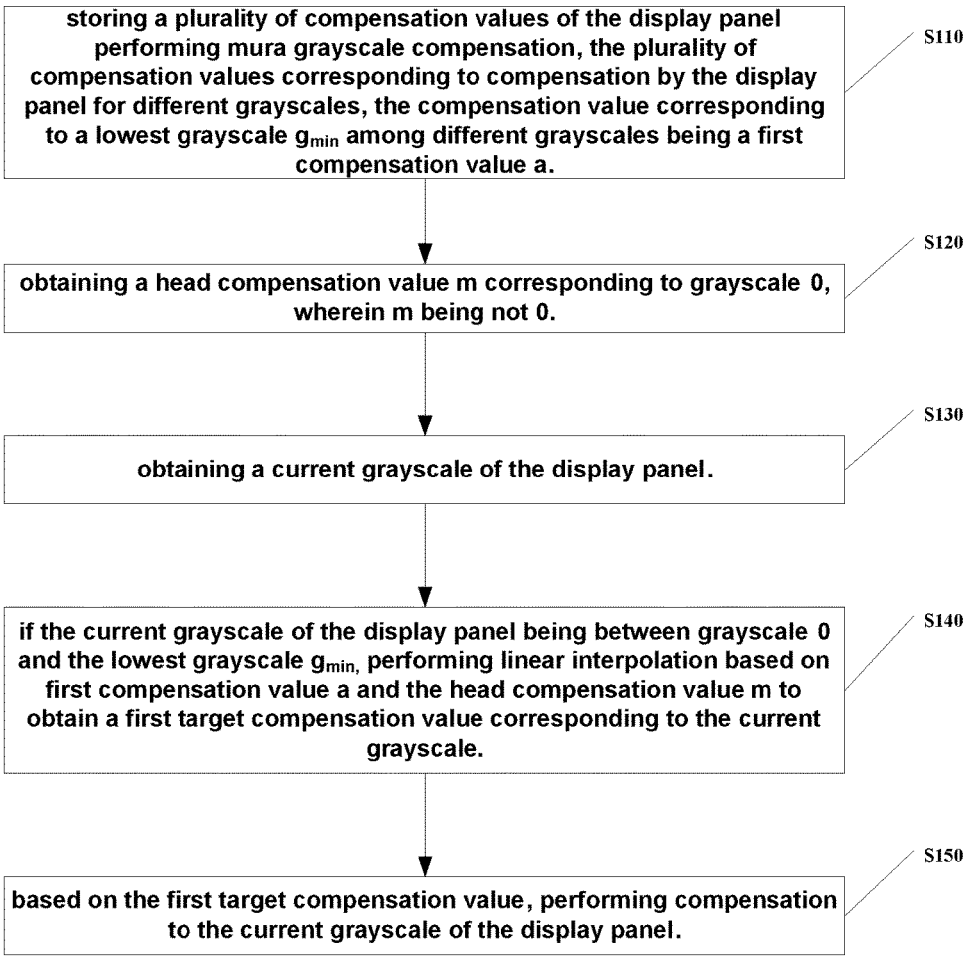
FIG. 2 is a flowchart showing the first embodiment of the mura compensation method for display panel according to the present invention.
Figure 3:
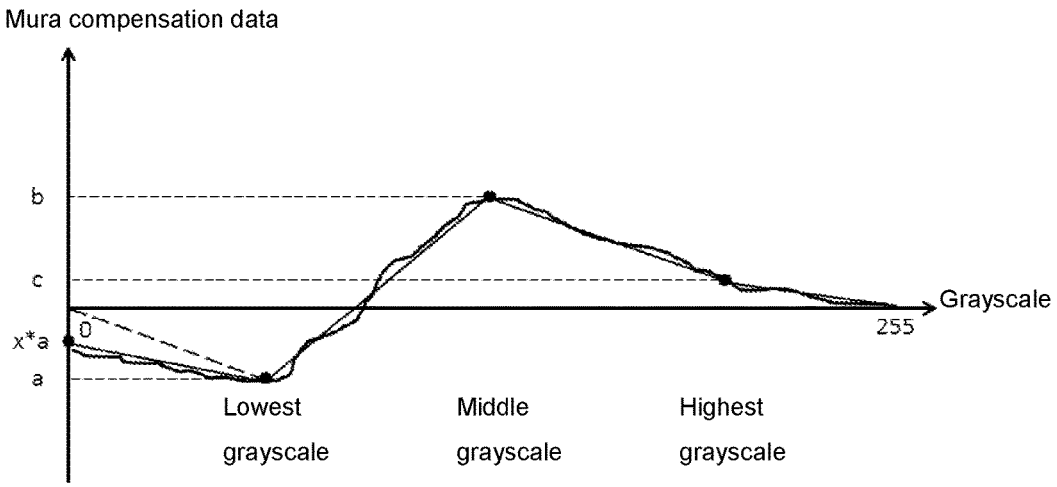
FIG. 3 is a schematic view showing the comparison among the actual mura compensation (solid line) by the first embodiment of the present invention, the actual mura compensation (dash line) obtained by linear interpolation in the know technology, and the actual needed mura compensation (solid curve).

The present invention provides a mura compensation method for display panel, wherein the display panel can be a liquid crystal display (LCD) panel or other types of display panel, referring to FIG. 2 and FIG. 3, the method comprising the following steps:

S110: storing a plurality of compensation values of the display panel performing mura grayscale compensation, the plurality of compensation values corresponding to compensation by the display panel for different grayscales, wherein the compensation value corresponding to a lowest grayscale $g_{min}$ among different grayscales being a first compensation value a.

Wherein, the display panel stores a plurality of compensation values for performing mura grayscale compensation, and the plurality of the compensation values are used to compensate different grayscales, respectively. In general, the plurality of compensation values comprise at least three compensation values, and at least three of the compensation values correspond to the low grayscale, the middle grayscale, the high grayscale, respectively. For example, in the present embodiment, the plurality of the compensation values comprises three compensation values: a first compensation a, a second compensation value b, and a third compensation value c. Among the three compensation values a, b, c, the first compensation value a corresponds to a grayscale (the lowest grayscale $g_{min}$) of the low grayscale for compensation; the second compensation value b corresponds to a grayscale (the middle grayscale $g_{mid}$) of the middle grayscale for compensation; the third compensation value c corresponds to a grayscale (the highest grayscale $g_{max}$) of the high grayscale for compensation.

In the present embodiment, the lowest grayscale $g_{min}$ among different grayscales corresponds to the first compensation value a. For example, the lowest grayscale $g_{min}$ corresponding to the first compensation value a is grayscale 25. The highest grayscale $g_{max}$ among different grayscales corresponds to the third compensation value c. For example, the highest grayscale $g_{max}$ corresponding to the third compensation value c is grayscale 200. The other stored compensation values correspond to the grayscales between the lowest grayscale $g_{min}$ and the highest grayscale $g_{max}$, such as, between grayscale 25 and grayscale 200.

S120: obtaining a head compensation value m corresponding to grayscale 0, wherein m being not 0.

Because the known technology sets the compensation value for grayscale 0 as 0, the grayscale 0 is not compensated, and the subsequent calculation of compensation values for grayscales between the grayscale 0 and the lowest grayscale $g_{min}$ does not achieve good mura compensation results. The actual situation is that the grayscale 0 still requires compensation. Accordingly, in the present embodiment, the display panel obtains the head compensation value m for grayscale 0, and the head compensation value m can be either calculated for measured. Therefore, the head compensation value m can be the actual compensation value or close to the actual compensation value, and the head compensation value m is not 0. In the present embodiment, the head compensation value m can be the same or different for different display panel.

S130: obtaining a current grayscale of the display panel.

Because the current grayscale changes dynamically when the display panel is displaying, the current grayscale must be obtained for grayscale compensation. Only when the current grayscale is between the grayscale 0 and the lowest grayscale $g_{min}$ the head compensation value m is used for calculating the compensation value.

S140: if the current grayscale of the display panel being between grayscale 0 and the lowest grayscale $g_{min}$, performing linear interpolation based on the first compensation value a and the head compensation value m to obtain a first target compensation value corresponding to the current grayscale.

If the current grayscale of the display panel being between grayscale 0 and the lowest grayscale $g_{min}$, performing linear interpolation based on the first compensation value a and the head compensation value m to obtain a first target compensation value corresponding to the current grayscale. Specifically, when the current grayscale is grayscale k, and when grayscale k is between grayscale 0 and the lowest grayscale $g_{min}$, the first target compensation value $y_k$ corresponding to the current grayscale k is computed as:

$$y_k=m+(k-0)*(a-m)/(g_{min}-0)$$

Assume that the lowest grayscale $g_{min}$ is grayscale 20, the grayscale k is the grayscale 10, then:

$$Y_{10}=m+(10-0)*(a-m)/(20-0)$$

Accordingly, as shown in FIG. 3, the comparison shows that the calculated first target compensation value between grayscale 0 and the lowest grayscale $g_{min}$ is closer to the actual needed compensation value than the known technology.

S150: based on the first target compensation value, performing compensation to the current grayscale of the display panel.

In the present embodiment, after calculating the first target compensation value, the compensation is performed to the current grayscale of the display panel based on the first target compensation value.

In the present embodiment, because the head compensation value for grayscale 0 is not set as 0, but as the actual compensation value or close to the actual compensation value, the first target compensation value calculated for grayscales between grayscale 0 and the lowest grayscale $g_{min}$ will perform mura compensation better and resulting in better display effect.

In the present embodiment, the head compensation value m=xa and x is a head compensation coefficient, $0<x<1$. Accordingly, the first target compensation value $y_k$ corresponding to the current grayscale k is computed as:

$$y_k=xa+(k-0)*(a-xa)/(g_{min}-0)$$

Accordingly, before obtaining the head compensation value for grayscale 0, a step must be included:

Storing a head compensation coefficient x.

Accordingly, the head compensation value can be calculated from the head compensation coefficient x. The value of the head compensation coefficient x is obtained by an external mura system. The external mura system increases the shooting of a low grayscale j (grayscale j is between grayscale 0 and the lowest grayscale $g_{min}$, preferably, grayscale j is between grayscale 10 and the lowest grayscale $g_{min}$, because the camera has a certain limit on sensitivity) mura form, and obtains the compensation data p corresponding to grayscale j. Based on the relation between the compensation data p of grayscale j and the first compensation value a, the head compensation coefficient x is calculated and stored. The compensation data p corresponding to grayscale j does not need to be stored in the flash, and the following equation computes the value of the coefficient x:

$$(p-x*a)/(a-x*a)=m/g_{min}$$

In the present embodiment, by storing the head compensation coefficient x (which is smaller in size) the storage space is saved. Apparently, in other embodiments, the head compensation vale m can be stored directly.

In the present embodiment, the head compensation coefficient x can be stored in a timing controller (Tcon IC). During the tuning stage, a fixed coefficient x is selected and stored in the Tcon IC. In other embodiments, the head compensation coefficient x can be stored in a data memory (flash). As such, depending on the actual situation of each display panel, different head compensation coefficient x can be selected. In the present embodiment, the plurality of compensation values corresponding to mura grayscale compensation are stored in a data memory.

In the present embodiment, the compensation value corresponding to a grayscale (called the lowest grayscale $g_{min}$) in the low grayscale is the first compensation value a, the compensation value corresponding to a grayscale (called the middle grayscale $g_{mid}$) in the middle grayscale is the second compensation value b, and the compensation value corresponding to a grayscale (called the highest grayscale $g_{max}$) in the high grayscale is the third compensation value c. Accordingly, if the current grayscale k of the display panel is between the lowest grayscale $g_{min}$ and the middle grayscale $g_{mid}$, perform the linear interpolation based on the first compensation value a and the second compensation value b to obtain a third target compensation value corresponding to the current grayscale k; based on the third target compensation value, performing compensation to the current grayscale k of the display panel. Specifically, the third target compensation value yk is calculated as:

$$y_k=a+(k-g_{min})*(b-a)/(g_{mid}-g_{min})$$

If the current grayscale k of the display panel is between the middle grayscale $g_{mid}$ and the highest grayscale $g_{max}$, perform the linear interpolation based on the second compensation value b and the third compensation value c to obtain a fourth target compensation value corresponding to the current grayscale k; based on the fourth target compensation value, performing compensation to the current grayscale k of the display panel. Specifically, the third target compensation value yk is calculated as:

$$y_k=b+(k-g_{mid})*(c-b)(g_{max}-g_{mid})$$

Moreover, in other embodiments, the second compensation value b does not exist, and the compensation value for a grayscale between the lowest grayscale $g_{min}$ and the highest grayscale $g_{max}$ can also be calculated by linear interpolation.

Figure 4:
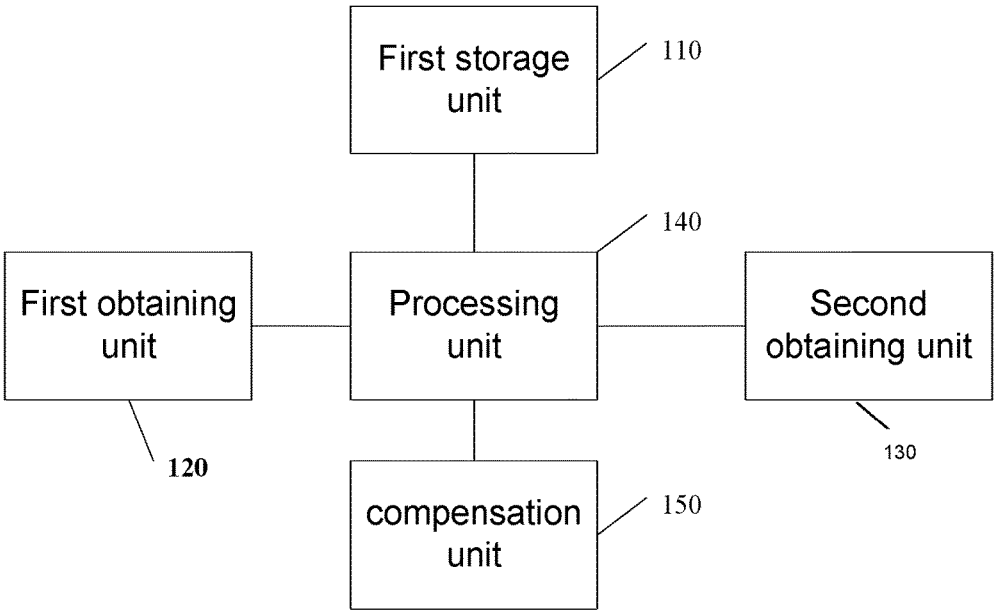
FIG. 4 is a schematic view showing the functional structure of the display panel according to an embodiment of the present invention.

The present invention also provides a display panel, as shown in FIG. 4, comprising:

a first storage unit 110, for storing a plurality of compensation values of the display panel performing mura grayscale compensation, the plurality of compensation values corresponding to compensation by the display panel for different grayscales, wherein the compensation value corresponding to a lowest grayscale $g_{min}$ among different grayscales being a first compensation value a;

a first obtaining unit 120, for obtaining a head compensation value m corresponding to grayscale 0, wherein m being not 0;

a second obtaining unit 130, for obtaining a current grayscale of the display panel;

a processing unit 140, for performing: if the current grayscale of the display panel obtained by the second obtaining unit 130 being between grayscale 0 and the lowest grayscale $g_{min}$, performing linear interpolation based on the first compensation value a and the head compensation value m to obtain a first target compensation value corresponding to the current grayscale.

If the current grayscale of the display panel obtained by the second obtaining unit 130 being between grayscale 0 and the lowest grayscale $g_{min}$, performing linear interpolation based on the first compensation value a and the head compensation value m to obtain a first target compensation value corresponding to the current grayscale. Specifically, if the current grayscale is grayscale k, and grayscale k is between grayscale 0 and the lowest grayscale $g_{min}$, the first target compensation value $y_k$ corresponding to the current grayscale k is computed as:

$$y_k=m+(k-0)*(a-m)/(g_{min}-0)$$

a compensation unit 150, for, based on the first target compensation value, performing compensation to the current grayscale of the display panel.

In the present embodiment, the first obtaining unit 102, the second obtaining unit 130, the processing unit 140 and the compensation unit 150 can all be integrated into a timing controller (Tcon IC), or as individual electronic components.

In the present embodiment, the head compensation value m obtained by the first obtaining unit 120: m=xa and x is a head compensation coefficient, 0<x<1; the display panel further comprises a second storage unit, for storing the head compensation coefficient x. In the present embodiment, the first storage unit and the second storage unit can be the same memory or different memories. In the present embodiment, the first storage unit is a data memory (flash), and the second storage unit is a data memory (flash) or a timing controller (Tcon IC).

In the present embodiment, the compensation value corresponding to a grayscale (called the lowest grayscale $g_{min}$) in the low grayscale is the first compensation value a, the compensation value corresponding to a grayscale (called the middle grayscale $g_{mid}$) in the middle grayscale is the second compensation value b, and the compensation value corresponding to a grayscale (called the highest grayscale $g_{max}$) in the high grayscale is the third compensation value c. Accordingly, if the current grayscale k of the display panel obtained by the second obtaining unit 130 is between the lowest grayscale $g_{min}$ and the middle grayscale $g_{mid}$, the processing unit 140 performs the linear interpolation based on the first compensation value a and the second compensation value b to obtain a third target compensation value corresponding to the current grayscale k; specifically, the third target compensation value yk is calculated as:

$$y_k=a+(k-g)*(b-a)/(g_{mid}-g_{min})$$

Based on the third target compensation value, the compensation unit 150 performs compensation to the current grayscale k of the display panel.

If the current grayscale k of the display panel obtained by the second obtaining unit 130 is between the middle grayscale $g_{mid}$ and the highest grayscale $g_{max}$, the processing unit 140 performs the linear interpolation based on the second compensation value b and the third compensation value c to obtain a fourth target compensation value corresponding to the current grayscale k; specifically, the third target compensation value yk is calculated as:

$$y_k=b+(k-g_{mid})*(c-b)/(g_{max}-g_{mid})$$

Based on the third target compensation value, the compensation unit 150 performs compensation to the current grayscale k of the display panel.

Moreover, in other embodiments, the second compensation value b does not exist, and the compensation value for a grayscale between the lowest grayscale $g_{min}$ and the highest grayscale $g_{max}$ can also be calculated by linear interpolation performed by the processing unit 140.

Moreover, in the present embodiment, because the compensation value for grayscale 255 is set to 0 (default, not accurate value), and the compensation value for grayscales between highest grayscale $g_{max}$ and grayscale 255 is calculated by linear interpolation. In general, the mura problem does not occur often, but to further improve the display quality, the present invention also provides a second embodiment to enhance the display quality.

The Second Embodiment

Figure 5:
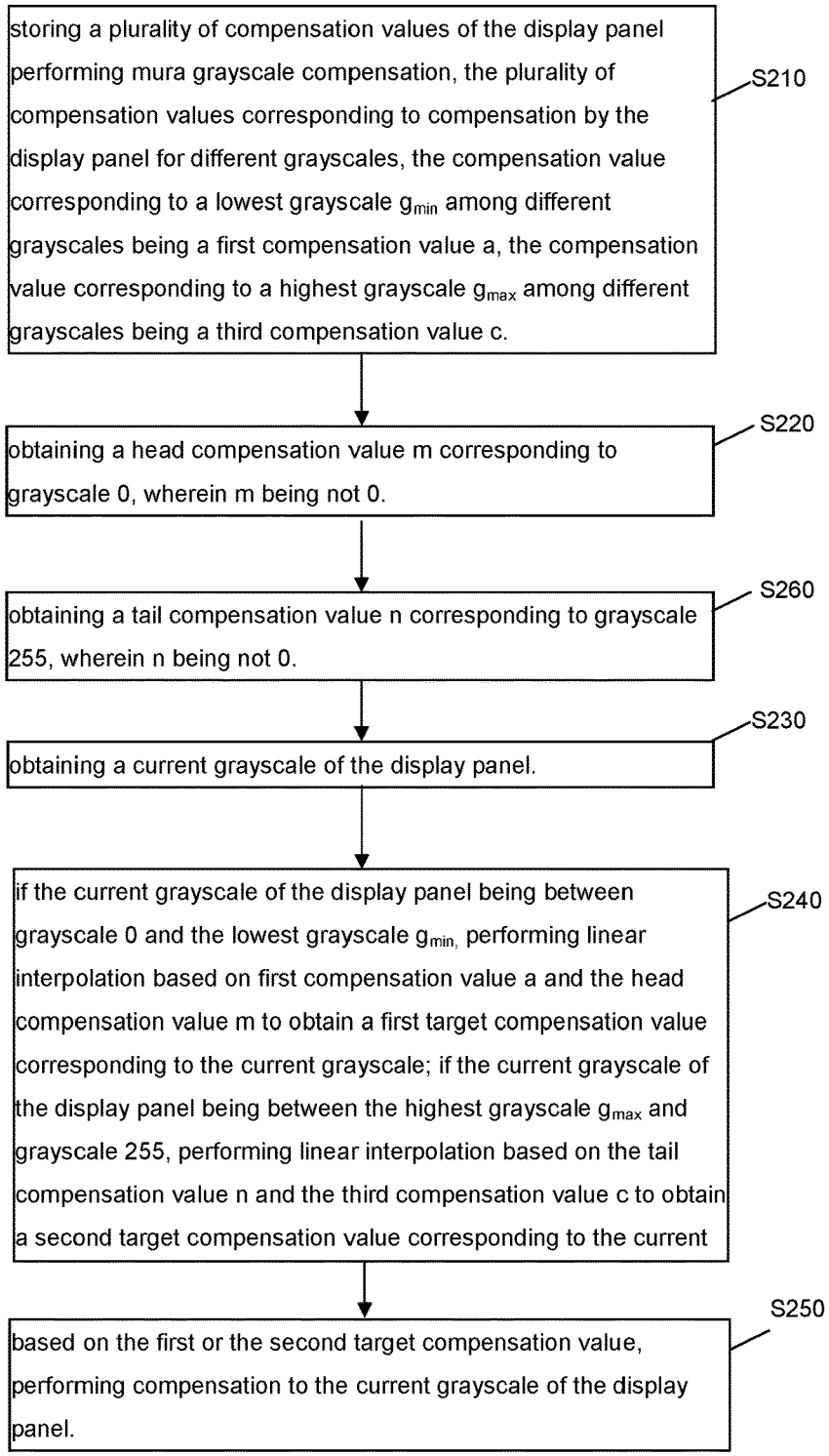
FIG. 5 is a flowchart showing the second embodiment of the mura compensation method for display panel according to the present invention.

FIG. 5 is a flowchart showing the second embodiment of the mura compensation method for display panel according to the present invention. The flowchart in FIG. 5 is similar to the flowchart in FIG. 2, except that the improvement on the compensation for grayscales between highest grayscale $g_{max}$ and grayscale 255. As shown in FIG. 5, the method comprises steps S210-S250.

S210: storing a plurality of compensation values of the display panel performing mura grayscale compensation, the plurality of compensation values corresponding to compensation by the display panel for different grayscales, wherein the compensation value corresponding to a lowest grayscale $g_{min}$ among different grayscales being a first compensation value a, and the compensation value corresponding to a highest grayscale $g_{max}$ among different grayscales being a third compensation value c.

In the present embodiment, the lowest grayscale $g_{min}$ among different grayscales corresponds to the first compensation value a, and the highest grayscale $g_{max}$ among different grayscales corresponds to the third compensation value c. In other words, the different grayscales comprises the lowest grayscale $g_{min}$ and the highest grayscale $g_{max}$, and the stored compensation values comprise the first compensation value a and the third compensation value c.

S220: obtaining a head compensation value m corresponding to grayscale 0, wherein m being not 0.

Step S220 is the same as S120, and will not be repeated here.

S260: obtaining a tail compensation value n corresponding to grayscale 255, n is not 0.

Because the known technology sets the compensation value for grayscale 255 as 0, the grayscale 255 is not compensated, and the subsequent calculation of compensation values for grayscales between the grayscale 255 and the highest grayscale $g_{max}$ does not achieve good mura compensation results. The actual situation is that the grayscale 255 still requires compensation. Accordingly, in the present embodiment, the display panel obtains the tail compensation value n for grayscale 255, and the tail compensation value n can be either calculated for measured. Therefore, the tail compensation value n can be the actual compensation value or close to the actual compensation value, and the tail compensation value n is not 0. In the present embodiment, the tail compensation value n can be the same or different for different display panel.

S230: obtaining a current grayscale of the display panel.

Step S230 is the same as S130, and will not be repeated here.

S240: if the current grayscale of the display panel being between grayscale 0 and the lowest grayscale $g_{min}$, performing linear interpolation based on the first compensation value a and the head compensation value m to obtain a first target compensation value corresponding to the current grayscale; if the current grayscale of the display panel being between the highest grayscale $g_{max}$ and grayscale 255, performing linear interpolation based on the tail compensation value n and the third compensation value c to obtain a second target compensation value corresponding to the current grayscale.

If the current grayscale k of the display panel being between grayscale 0 and the lowest grayscale $g_{min}$, performing linear interpolation based on the first compensation value a and the head compensation value m to obtain a first target compensation value $y_k$ corresponding to the current grayscale k, computed as:

$$y_k=m+(k-0)*(a-m)/(g_{min}-0)$$

If the current grayscale of the display panel being between the highest grayscale $g_{max}$ and grayscale 255, performing linear interpolation based on the third compensation value c and the tail compensation value n to obtain a second target compensation value corresponding to the current grayscale. Specifically, when the current grayscale is grayscale k, and when grayscale k is between the highest grayscale $g_{max}$ and grayscale 255, the second target compensation value $y_k$ corresponding to the current grayscale k is computed as:

$$y_k=n+(255-k)*(c-n)/(255-g_{max})$$

Assume that the highest grayscale $g_{max}$ is grayscale 200, the grayscale k is the grayscale 240, then:

$$Y_{240}=n+(255-240)*(c-n)/(255-200)$$

S250: based on the first target compensation value or the second target compensation value, performing compensation to the current grayscale of the display panel.

In the present embodiment, after calculating the first target compensation value or the second target compensation value, the compensation is performed to the current grayscale of the display panel based on the first or second target compensation value.

In the present embodiment, because the head compensation value for grayscale 255 is not set as 0, but as the actual compensation value or close to the actual compensation value, the second target compensation value calculated for grayscales between the highest grayscale $g_{max}$ and the grayscale 255 will perform mura compensation better and resulting in better display effect.

Compared to the first embodiment, the present embodiment does neither set the head compensation value m to 0 nor the tail compensation value n to 0. Instead, an actual compensation value m and n values or close to actual compensation values are used. So that when the grayscale is between grayscale 0 and the lowest grayscale $g_{min}$ or between the highest grayscale $g_{max}$ and the grayscale 255, the first and second target compensation value provides better mura compensation results, and leading to better display quality.

In the present embodiment, the tail compensation value n=yc, and y is a tail compensation coefficient, $0<y<1$. The tail compensation coefficient y can be obtained in the same way as the head compensation coefficient x, and the tail compensation coefficient can also be stored in the timing controller or a data memory.

It should be noted that each of the embodiments in this specification is described in a progressive manner, each of which is primarily described in connection with other embodiments with emphasis on the difference parts, and the same or similar parts may be seen from each other. For the device embodiment, since it is substantially similar to the method embodiment, the description is relatively simple and the relevant description may be described in part of the method embodiment.

With the above description, the present invention provides the following advantages:

Because the head compensation value corresponding to grayscale 0 is not defaulted to 0, but an actual head compensation value m close to actual value, so that the first target compensation value obtained by linear interpolation for the grayscales between the grayscale 0 and the lowest grayscale $g_{min}$ will be closer to the actual compensation value, resulting in a better mura compensation effect for the grayscales between the grayscale 0 and the lowest grayscale $g_{min}$ and leading to better display effect.

Embodiments of the present invention have been described, but not intending to impose any unduly constraint to the appended claims. Any modification of equivalent structure or equivalent process made according to the disclosure and drawings of the present invention, or any application thereof, directly or indirectly, to other related fields of technique, is considered encompassed in the scope of protection defined by the claims of the present invention.

What is claimed is:

1. A mura compensation method for display panel, comprising:

storing a plurality of compensation values of the display panel performing mura grayscale compensation, the plurality of compensation values corresponding to compensation by the display panel for different grayscales, wherein the compensation value corresponding to a lowest grayscale $g_{min}$ among different grayscales being a first compensation value a;

obtaining a head compensation value m corresponding to grayscale 0, wherein m being not 0;

obtaining a current grayscale of the display panel;

if the current grayscale of the display panel being between grayscale 0 and the lowest grayscale $g_{min}$, performing linear interpolation based on the first compensation value a and the head compensation value m to obtain a first target compensation value corresponding to the current grayscale;

based on the first target compensation value, performing compensation to the current grayscale of the display panel;

wherein m=xa and x is a head compensation coefficient, 0<x<1.

2. The mura compensation method for display panel as claimed in claim 1, wherein a k-th grayscale of the current grayscale located between grayscale 0 and the lowest grayscale $g_{min}$ corresponds to the first target compensation value $y_k$ is computed as:

$$y_k=m+(k-0)*(a-m)/(g_{min}-0).$$

3. The mura compensation method for display panel as claimed in claim 1, wherein the head compensation coefficient x is stored in a timing controller or in a data memory.

4. The mura compensation method for display panel as claimed in claim 1, wherein the compensation value corresponding to a highest grayscale $g_{max}$ among different grayscales is a third compensation value c, and the method further comprises:

obtaining a tail compensation value n corresponding to grayscale 255, n is not 0;

if the current grayscale of the display panel being between the highest grayscale $g_{max}$ and grayscale 255, performing linear interpolation based on the tail compensation value n and the third compensation value c to obtain a second target compensation value corresponding to the current grayscale;

based on the second target compensation value, performing compensation to the current grayscale of the display panel.

5. The mura compensation method for display panel as claimed in claim 4 wherein n=yc, and y is a tail compensation coefficient, 0<y<1.

6. The mura compensation method for display panel as claimed in claim 1, wherein the different grayscales further comprises a middle grayscale $g_{mid}$ and a highest grayscale $g_{max}$; the middle grayscale $g_{mid}$ is between the lowest grayscale $g_{min}$ and the highest grayscale $g_{ma}$x; the middle grayscale $g_{mid}$ corresponds to a second compensation value b, and the highest grayscale $g_{max}$ corresponds to a third compensation value c; the method further comprises:

if the current grayscale of the display panel being between the lowest grayscale $g_{min}$ and the middle grayscale $g_{mid}$, performing linear interpolation based on the first compensation value a and the second compensation value b to obtain a third target compensation value corresponding to the current grayscale; based on the third target compensation value, performing compensation to the current grayscale of the display panel; or, the current grayscale of the display panel being between the middle grayscale $g_{mid}$ and the highest grayscale $g_{max}$, performing linear interpolation based on the second compensation value b and the third compensation value c to obtain a fourth target compensation value corresponding to the current grayscale; based on the fourth target compensation value, performing compensation to the current grayscale of the display panel.

7. A display panel, comprising:

a first storage unit, for storing a plurality of compensation values of the display panel performing mura grayscale compensation, the plurality of compensation values corresponding to compensation by the display panel for different grayscales, wherein the compensation value corresponding to a lowest grayscale $g_{min}$ among different grayscales being a first compensation value a;

a first obtaining unit, for obtaining a head compensation value m corresponding to grayscale 0, wherein m being not 0;

a second obtaining unit, for obtaining a current grayscale of the display panel;

a processing unit, for performing: if the current grayscale of the display panel obtained by the second obtaining unit being between grayscale 0 and the lowest grayscale $g_{min}$, performing linear interpolation based on the first compensation value a and the head compensation value m to obtain a first target compensation value corresponding to the current grayscale;

a compensation unit, for, based on the first target compensation value, performing compensation to the current grayscale of the display panel;

wherein m=xa and x is a head compensation coefficient, 0<x<1; the display panel further comprises a second storage unit, for storing the head compensation coefficient x.

8. The display panel as claimed in claim 7, wherein the first storage unit is a data memory, and the second storage unit is a data memory or a timing controller.

* * * * *